US007852232B2

(12) United States Patent
Hall et al.

(10) Patent No.: US 7,852,232 B2
(45) Date of Patent: Dec. 14, 2010

(54) DOWNHOLE TOOL ADAPTED FOR TELEMETRY

(75) Inventors: David R. Hall, Provo, UT (US); Joe Fox, Provo, UT (US)

(73) Assignee: IntelliServ, Inc., Provo, UT (US)

( * ) Notice: Subject to any disclaimer, the term of this patent is extended or adjusted under 35 U.S.C. 154(b) by 1515 days.

(21) Appl. No.: 10/358,421

(22) Filed: Feb. 4, 2003

(65) Prior Publication Data

US 2004/0150533 A1 Aug. 5, 2004

(51) Int. Cl.
*G01V 3/00* (2006.01)

(52) U.S. Cl. ..... 340/854.4; 340/853.7; 340/854.9; 367/82; 439/190; 439/194; 285/333

(58) Field of Classification Search ..... 340/853.7, 340/854.4, 854.9; 439/190, 194; 166/65.1; 367/82, 297; 175/40; 785/333
See application file for complete search history.

(56) References Cited

U.S. PATENT DOCUMENTS

| | | | |
|---|---|---|---|
| 0,749,633 | A | 1/1904 | Seely |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,170,137 | A | 2/1965 | Brandt |
| 3,186,222 | A | 6/1965 | Martin |
| 3,194,886 | A | 7/1965 | Mason |
| 3,209,323 | A | 9/1965 | Grossman, Jr. |

(Continued)

FOREIGN PATENT DOCUMENTS

| | | | |
|---|---|---|---|
| EP | 0399987 | A1 | 11/1990 |

(Continued)

*Primary Examiner*—Albert K. Wong
(74) *Attorney, Agent, or Firm*—Jeffery E. Daly

(57) ABSTRACT

A cycleable downhole tool such as a Jar, a hydraulic hammer, and a shock absorber adapted for telemetry. This invention applies to other tools where the active components of the tool are displaced when the tool is rotationally or translationally cycled. The invention consists of inductive or contact transmission rings that are connected by an extensible conductor. The extensible conductor permits the transmission of the signal before, after, and during the cycling of the tool. The signal may be continuous or intermittent during cycling. The invention also applies to downhole tools that do not cycle, but in operation are under such stress that an extensible conductor is beneficial. The extensible conductor may also consist of an extensible portion and a fixed portion. The extensible conductor also features clamps that maintain the conductor under stresses greater than that seen by the tool, and seals that are capable of protecting against downhole pressure and contamination.

25 Claims, 9 Drawing Sheets

U.S. PATENT DOCUMENTS 3,227,973 A 1/1966 Gray
3,253,245 A 5/1966 Brandt
3,518,608 A 6/1970 Papadopoulos
3,696,332 A 10/1972 Dickson, Jr. et al.
3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 Macleod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,396,965 A 3/1995 Hall et al.
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 Van Steenwyk et al.
6,196,335 B1 3/2001 Rodney
6,209,632 B1 4/2001 Holbert et al.
6,223,826 B1 5/2001 Chau et al.
6,308,940 B1 10/2001 Anderson
6,367,565 B1 4/2002 Hall
6,392,317 B1 5/2002 Hall et al.
6,405,795 B2 6/2002 Holbert et al.
6,481,495 B1 11/2002 Evans
6,641,434 B2 11/2003 Boyle et al.
6,655,464 B2 12/2003 Chau et al.
6,670,880 B1 12/2003 Hall et al.
6,830,467 B2 * 12/2004 Hall et al. ..... 439/194
6,844,498 B2 * 1/2005 Hall et al. ..... 174/75 C
2002/0075114 A1 6/2002 Hall et al.
2002/0135179 A1 9/2002 Boyle et al.
2002/0193004 A1 12/2002 Boyle et al.
2003/0070842 A1 4/2003 Bailey et al.
2003/0213598 A1 11/2003 Hughes

FOREIGN PATENT DOCUMENTS

WO W8801096 2/1988
WO WO9014497 11/1990
WO WO 02/06716 A1 1/2002

* cited by examiner

DOWNHOLE TOOL ADAPTED FOR TELEMETRY

U.S. GOVERNMENT INTEREST

This invention was made with government support under Contract No. DE-FC26-01NT41229 awarded by the U.S. Department of Energy. The government has certain rights in the invention.

RELATED APPLICATIONS

None

BACKGROUND OF THE INVENTION

This invention relates generally to downhole tools joined in a tool string and forming a downhole telemetry network. These tools often have components that are displaced in rotation and translation during use. More particularly, this invention relates to downhole tools comprising transmission rings connected by an extensible transmission line that permits signal transmission during the operation of the tool.

Real time telemetry via a downhole network has long been desired by the oil, gas, and geothermal well drilling industries. Although there is much literature on the subject, until now, a commercial system offering real time high-speed data rates has not been available. This invention is an application of the first successfully demonstrated downhole high-speed telemetry network. This enabling technology allows real-time bidirectional telemetry all along the drill string between the drill bit and the surface. The investigator is directed to the applicants' U.S. Pat. No. 6,392,317, pending U.S. Application 20020075114A1, and pending PCT application WO2001US0022542, incorporated herein by this reference, for further details concerning the nature and application of the invention.

This invention pertains to drilling tools that undergo rotational or extensional cycling, either continuously or on demand in the drilling operation. A modern drill string, or tool string, is made up of many different tools. Some of them are passive, while others are active, performing drilling functions in addition to providing a torque connection between the drill bit and the surface platform. The objective of this invention is to provide a means for accommodating the cycling of such tools while enabling transmission of data along the string. Examples of tools that undergo rotational or extensional cycling, either continuously or on demand in the tool string are found in the following U.S. Patents.

U.S. Pat. No. 6,481,495, to Evans, discloses a downhole tool known as a hydraulic drilling Jar. It teaches the use of a telescoping mandrel positioned in the housing of the tool. The mandrel provides an annulus housing the active components of the tool. The tool also provides for a conductor member positioned in association with the mandrel for transmitting an electronic signal through the tool. The conductor is insulated from the conductive drilling fluid by means of a sealed chamber filled with a non-conductive fluid. The disclosure goes on to teach that the conductor is designed to elongate as the tool cycles. The means for providing elongation of the conductor is supplied forming the conductor cable into a helix. This disclosure relies on a variety of direct contact components to complete the electrical path through the tool.

U.S. Pat. No. 5,396,965, to Hall et al., one of the inventors herein, discloses a downhole hammer for use in a drill string. The abstract of the invention discloses the general nature of the hammer and its use downhole. According to its broadest aspect, the invention is a down-hole mud actuated hammer for use in a drill string, which includes a housing with an upper end having means for connecting to the drill string. A throat is located within the housing, which throat includes a main flow passage to allow high pressure drilling mud to pass there through. A piston is provided which is adapted to move axially within the housing means to reciprocate between an up position and a down position. The piston is moved between the up and down position by a minor portion of the high pressure mud, which portion passes from the main flow passage into at least one piston actuating chamber. This minor portion of mud is exhausted from the piston actuating chamber to a low pressure region out of the housing without being returned to the main flow passage. The present invention teaches how this tool may be adapted for inclusion in a downhole network.

U.S. Pat. No. 6,308,940, to Anderson, discloses a downhole shock absorber for use in a drill string. The tool employs both rotationally and translationally actuated components to dampen the drill string vibrations present in drilling deep wells. The tool comprises multiple segments that are threadably connected together to provide a tool compatible with standard drill string components and makeup. The assembly allows for longitudinal telescoping movement of the active components of the tool which are housed in an annulus that is defined by an axial flow passage and by the tool's housing. The flow passageway permits the circulation of drilling fluid through the tool and the tool's housing. The operation of the tool is described as follows. If the shock wave impinges on the tool, a mandrel telescopes into the drive cylinder. This allows continued rotational movement while simultaneously absorbing, by both mechanical and hydraulic means, the energy of the shock. The shock is dampened by the movement of the mandrel into the annular space provided by the drive cylinder, connector sub and compression cylinder. The present invention teaches how this tool may be adapted for inclusion in a downhole network.

This invention, therefore, provides a means for adapting downhole tools that undergo rotational or translational cycling for inclusion in a high-speed telemetry network down hole. Real time data may then be transmitted to and from the drill bit and other sensors and equipment along the drill string.

SUMMARY OF THE INVENTION

This invention constitutes a downhole tool that is fitted with transmission rings that are joined by an extensible transmission line. The transmission line may also be joined to rings and sensors. The classes of tools that may benefit from this invention are those that cycle during operation in either rotation or translation. Such tools are Jars, hydraulic hammers, shock absorbers, and mud motors. Many other tools are likely to benefit from this invention such as mud pulsers and sirens, steering tools, blowout preventors, and downhole generators. Some passive tools may also benefit from the invention where the strain on the tool is so great that an extensible transmission line would be beneficial.

The transmission rings are either contact or non-contact depending on the specific application. Contact rings are those that generally have smooth mating surfaces and propagate the signal by the direct contact of one ring against another. Coupling rings are those that rely on a shared electromagnetic field as a means for transmitting the signal. Coupling rings may also contact one another or they may be designed so that a gap is always present between the mating surfaces.

All downhole tools in a drill string are joined together by means of box and pin end tool joints. Most tool joints rely on an annular shoulder to create the torque required to withstand the stresses of the drill string. When the joint is made up, that is when a pin end is screwed into a box end, the respective shoulders contact one another. Therefore, the mating shoulders are a suitable location for the transmission rings. The rings are then attached to a transmission line that runs the length of the tool. The transmission line may be flexible or rigid or a combination of both.

The purpose of this invention is to disclose a tool that is adapted for the transmission of an electronic signal. The particulars of this invention and its application will become apparent in reference to the following explanation associated with the following figures. These figures are by way of illustration only and are not intended to limit the scope of this invention. Those skilled in the art will undoubtedly recognize additional application for the concepts presented herein. This disclosure is intended to incorporate those concepts as well.

DETAILED DESCRIPTION OF THE INVENTION

The detailed description of this invention will be in reference to the following figures.

Figure 1:
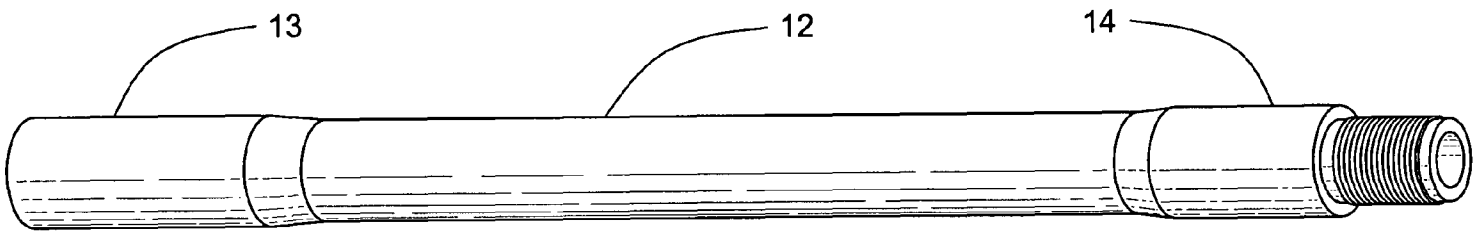
FIG. 1 is a diagram of a downhole tool.

FIG. 1 is a diagram of a downhole tool. The tool comprises an elongate tube 12 having a box end tool joint 13 and a pin end tool joint 14. Typically, downhole tools are configured with similar joints, regardless of their function. The uniform appearance of the tools enables their use in the tool string in a variety of drilling applications. It also facilitates handling of the tool in a fashion that does not interrupt the handling of more common drill string components such as drill pipe and drill collars.

The active components of the tool must be constrained to the geometry of the downhole tool. In some tools, this requires that two or more sections are joined together using modified tool joints in order to a length consistent with standard drilling tools. For example, as noted above, a drilling jar, mud hammer, or shock absorber may consist of multiple sections wherein are housed the active components of the tool. When the sections are joined together, the outside appearance of the tool should be similar to that shown in FIG. 1, in order for it be compatible with other tools in the string. An objective of this invention, therefore, is to provide a transmission network that allows drill string components to be made up using standard practices.

Figure 2:
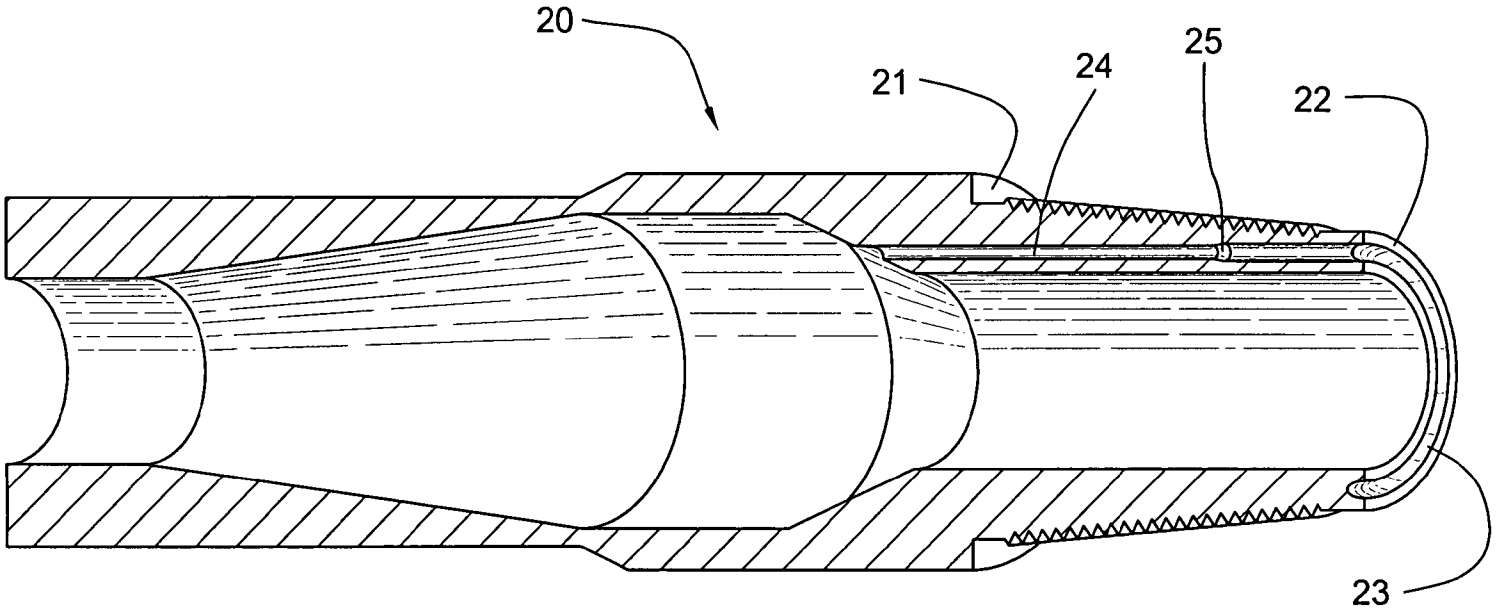
FIG. 2 is a sectioned diagram of a pin end downhole tool joint adapted for a transmission ring and extensible transmission line.
Figure 3:
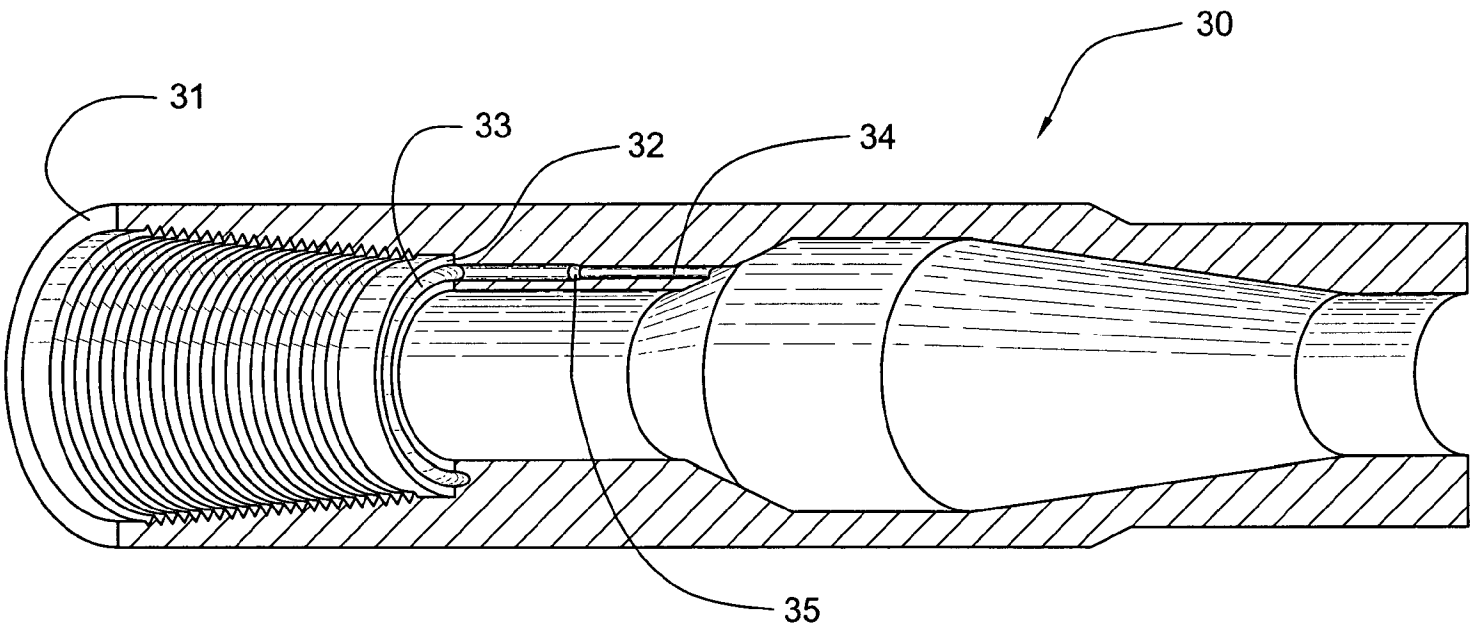
FIG. 3 is a sectioned diagram of a box end tool joint adapted for a transmission ring and extensible transmission line.

FIGS. 2 and 3 are sectioned diagrams of a pin end tool joint 20 and a box end tool joint 30. They feature primary shoulders 21 and 31, respectively, and a secondary shoulder 22 and 32, respectively. When the joints are made up, that is joined with a mating box or pin end tool joint to a predetermined torque, the respective shoulders are engaged. The primary shoulders 21 and 31, in most cases, produce the amount of torque required by the tool string. Although the secondary shoulders engage one another when the joint is properly made up, in normal operation they see very little force. However, the rigors of drilling often cause an over torque condition in the down hole tools. Therefore, it is the function of the secondary shoulder to take up the additional torque and protect the joint from twisting off. Because the secondary shoulder is less stressed in normal operation, it is preferred over the primary shoulder for the location of the transmission rings. Nevertheless, the primary shoulder may provide an adequate location for the transmission rings in some applications. Grooves 23 and 33, therefore, have been provided in the secondary shoulders to receive the transmission rings. Openings 24 and 34 connect the groove with the inside wall of the joint and provide a passageway for the installation of the transmission line. Internal shoulders 25 in FIG. 2, and 35 in FIG. 3, are provided in the inside wall of the openings. These internal shoulders provide a landing for expansion ferrules that are inserted into the transmission line. The expansion ferrules normally comprise a tapered cylinder having an insulated axial opening to permit passage of the transmission line's center conductor. The taper is slightly larger than the inside diameter of the transmission line housing so that as the ferrule is inserted it expands the housing outwardly against the wall of the opening. The ferrule fixes the transmission line against the shoulders 25 and 26 and 35 and 36, respectively, with such force that the transmission line may be held in tension during the operation of the drilling tool. Since an objective of this invention is to provide a network that is requires no changes in standard tool string makeup procedures, the transmission rings must be installed in such a manner that they do not compromise the integrity of the secondary shoulder. Furthermore, in the event that the secondary shoulders experience an over torque condition downhole, the transmission rings must be able to survive the additional force placed upon the shoulder surrounding the groove. Analysis has shown that the stresses from over torquing will tend to collapse regular walled grooves inwardly on the transmission ring. To better resist the applied forces, the grooves, therefore, are preferably contoured with a circular or elliptical bottom, and provided with walls that diverge from bottom to top. When the transmission rings couple electromagnetically, the applicants have found that it is beneficial to position the surfaces of the transmission rings so that they are flush or slightly below the face of the shoulder. This further reduces the risk of damage to the ring during extreme make up of the joint.

Figure 4:
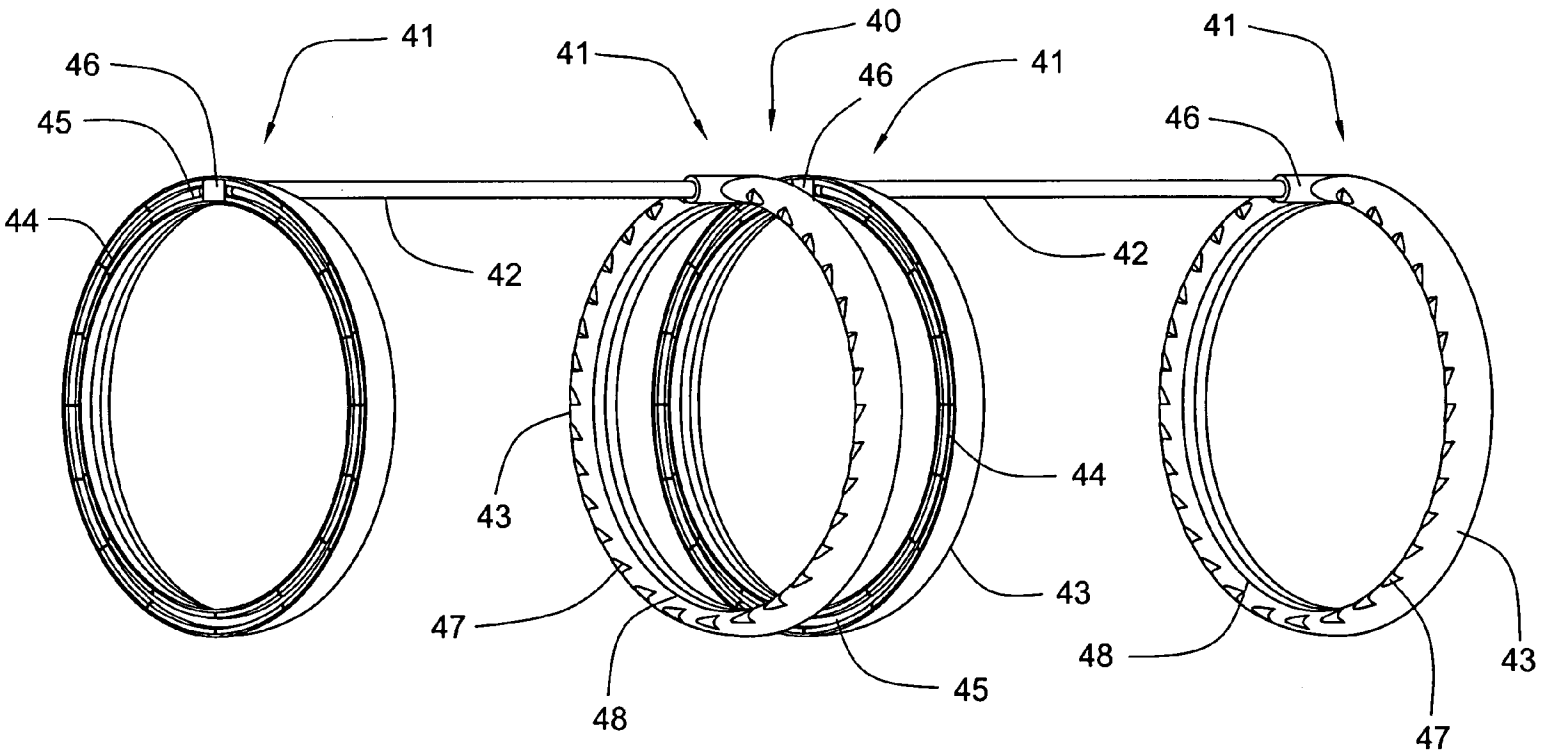
FIG. 4 is a diagram of a transmission line network for downhole tools in the tool string.

FIG. 4 is a diagram of an electromagnetically-coupled transmission line network 40. It comprises transmission rings 41 connected by a transmission line 42. The transmission rings consist of a housing 43 lined with trough-shaped magnetically conductive insulators segments 44 for housing an insulated coil 45, a connector 46, and a polymer seal (not shown for clarity). The polymer seal may be potted, or it may comprise o-ring seal between the core and inside diameter of a coaxial transmission line. An alternative to the trough segments is the use of a single magnetically conductive housing for the insulated coil 45. The polymer seal protects the components of the ring from damage from drilling fluid. The network shown in FIG. 4 is a electromagnetically coupled, and the transmission rings need not necessarily be in contact with each other. A network using contact transmission rings would be similar except that a contact surface would be provided in the place of the insulated coil conductor 45. The housing 43 is designed to mate with the contour of the groove in the secondary shoulder of the tool joint (23 of FIG. 2 or 33 of FIG. 3). The outside surface of the ring housing may exhibit discontinuities such as barbs 47 and 48 to aid in fixing the ring in the groove. Other anti-rotational discontinuities are acceptable. These discontinuities aid in preventing the rings from rotating under the pressure and friction of joint make up and assist in preventing the ring from pulling out of the groove after repeated cycling of the tool joint. The rings may be held in place using a polymer adhesive or encapsulant or by an interference fit. Furthermore, the outside surface of the rings may be contoured with surface irregularities that would promote mechanical retention within the groove. Although, the rings shown are non-contact transmission rings that rely on a shared electromagnetic filed to propagate the signal from one to another and need not be in direct contact, it is desirable that they come into close proximity during joint makeup, and light contact has been shown to be beneficial. In field tests, the network of the present invention has shown a surprising ability to passively transmit a broad band carrier signal for over 1000 feet of linked downhole tools, with data rates of two million bits per second. It is anticipated that the signal may be detectable for more than 2000 feet. Powered links stationed at intervals of 1000 to 2000 feet along the drill string enable a signal to be transmitted in both directions between sensors near the drill bit and equipment at the surface during the drilling operation. The powered links may also be connected to sensors placed at predetermined locations in the tool string for providing information on the dynamics of the string, the condition of the surrounding borehole, fluid flow, pressure, temperature, composition of the surrounding formation, and to provide for seismic sources and receivers to enable formations ahead of the bit to be located precisely on the surface seismic map. In particular, sensors placed at the powered links might enhance safety by quickly detecting dangerous conditions developing in the string or the borehole.

Figure 5:
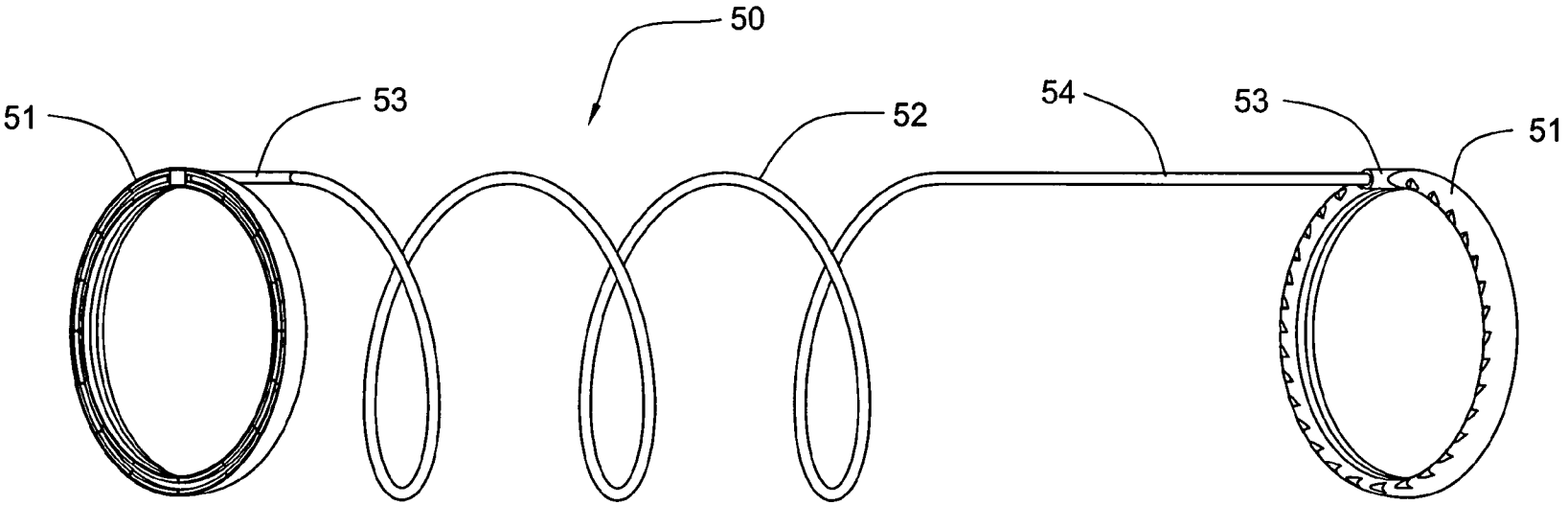
FIG. 5 is a diagram of transmission rings joined by an extensible transmission line within a spiral housing.

FIG. 5 is a diagram of a transmission line network 50 wherein the transmission line is housed in a sealed spiral conduit 52. The transmission rings 51 are similar to those depicted in FIG. 4 and are connected to the transmission line 52 by means of connectors 53. The transmission line is preferably housed in a stainless steel conduit that is sealed from the pressure and contaminants that are found downhole. The spiral conduit provides a means for accommodating the linear motion of a downhole tool mechanism without interrupting the signal. The transmission line may consist of both spiral 52 and straight 54 portions. Typically, clamps would be positioned so as to divide the spiral portion from the straight portion, thereby permitting the spiral portion to flex with linear motion of the tool while the straight portion is held rigidly, or in tension. In order to prevent fatigue in the transmission line, the spiral portion of the transmission line would be held in sufficient tension or compression so that as the tool cycles, the transmission line is not additionally strained. By the same token, it may be advisable for the straight portion of the line to be held in sufficient tension that it never sees a compressive stress for the same reason. A tool string is always held in tension since the weight of the string often exceeds the compressive strength of the drill string components. Therefore, the transmission line, since it is necessarily connected to the drill string components, must likewise have the tensile strength sufficient to withstand the stress on the string.

Figure 6:
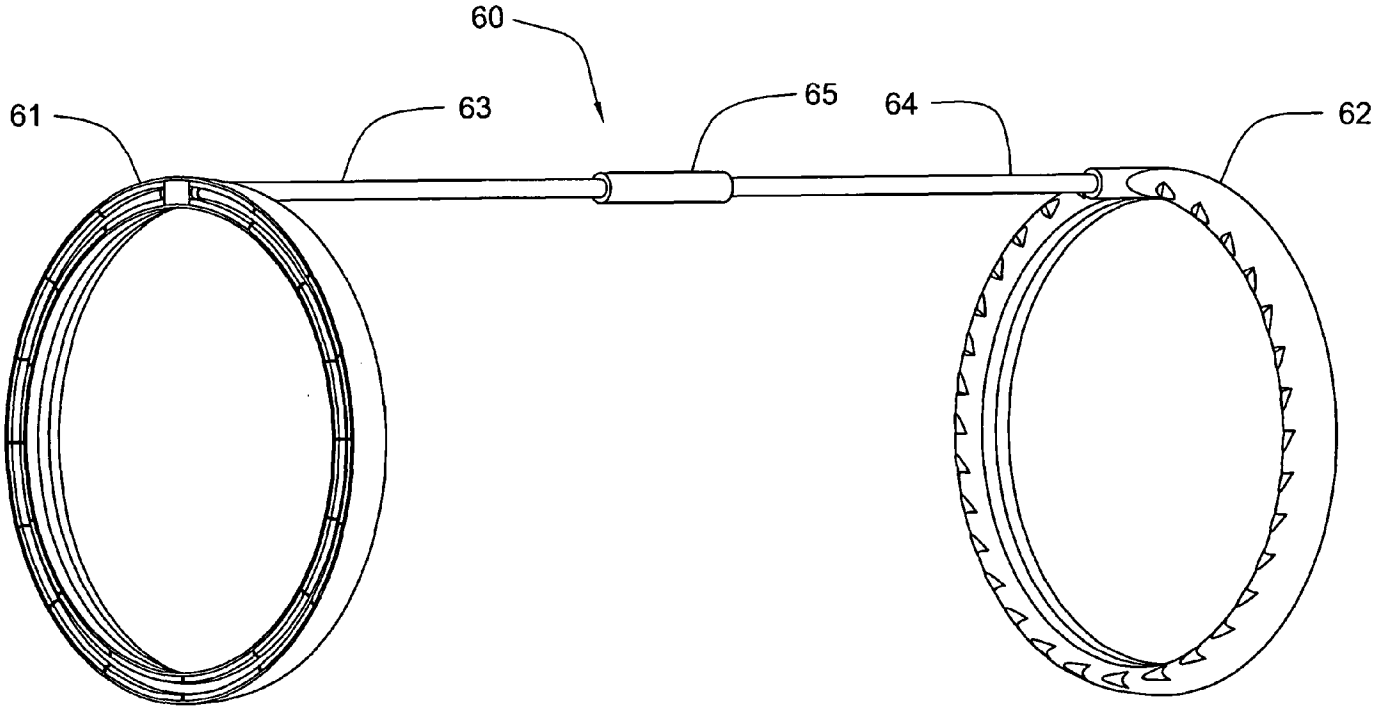
FIG. 6 is a diagram of transmission rings joined by a transmission line comprising a telescoping connector.

FIG. 6 is a diagram of a transmission network 60 consisting of transmission rings 61 and 62 and transmission line 63 and 64. The transmission lines 63 and 64 are coupled with a telescoping connector 65. The telescoping connector 65 enables linear motion of the down hole tool without interrupting the transmission lines' ability to the transmit the signal from ring 61 to ring 61 and vice versa. Tools used in applications that impose high stresses on the tool string components are also likely to benefit from the use an extensible transmission line as depicted in FIG. 6. Also, it is contemplated that portions of transmission lines 63 and 64 would be clamped in such a manner that they could be held in tension while the free portion of the transmission line proximate the telescoping connector 65 would be allowed to move as the tool cycles in extension. The specific features of the telescoping connector are depicted in FIG. 7.

Figure 7:
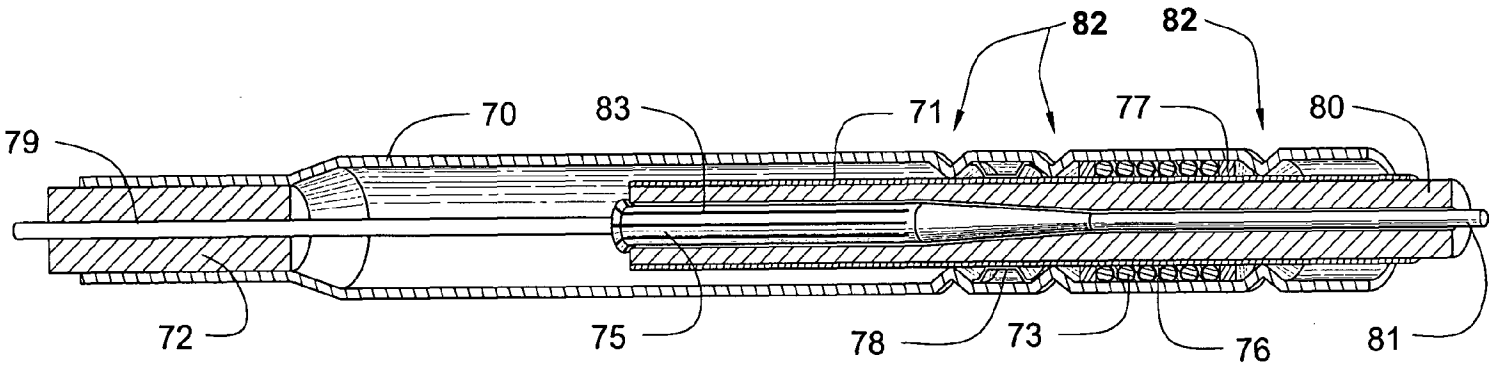
FIG. 7 is a section diagram of the telescoping connector of FIG. 6.

FIG. 7 is a sectioned diagram of the telescoping coaxial connector of FIG. 6. The connector may be used in combination with other means for extending the transmission line shown in this application. The connector features an expanded portion 70 of the transmission line housing 64, of FIG. 6, that serves as a receptacle for the mating portion 71 of transmission line 63, of FIG. 6. The standard components of the transmission line are depicted as the center conductor 79 and 81 and the dielectric 72 and 80. The shield, which is wrapped around the dielectric between dielectric and the housing 70 and 71, is not shown. It consists of a thin metallic foil or braid that is usually wrapped around the dielectric and serves as the outside electrical path for the coaxial circuit. Expanded portion 75, which has a slightly smaller inside diameter that the outside diameter of the mating center conductor 79, is attached to the center conductor 81 and comprises slits 83 that serve as a spring loaded contact receptacle for the center conductor 79. 78 is a spring loaded contact ring to insure a reliable connection between the coaxial components so that there is no interruption in the circuit as the transmission line is extended and retracted during operation of the downhole tool. Although the components of the connector are depicted as being loosely fit together for clarity and definition, they are actually closely fitted to one another, preferably under spring tension, to provide a connector that resists the shocks and vibrations of the downhole environment. In order to permit the telescoping movement of the connector and to seal out the contaminants that are present downhole, the connector is provided with a multiple seal system that includes o-rings 73, o-ring supports 76, and annular backups 77. Downhole pressures often exceed 20,000 psi, and this seal is capable of preventing the high pressure intrusion of contaminants that would otherwise short out the connection. Alternatively, the housing 70 can be provided with a bellows configuration that allows extension, in which case it can be permanently attached to the mating portion 71 of the transmission line. Annular crimps 82 are used to hold the contact ring 78 and the seal system in place. The crimp is also used to as a wiper to help remove debris from the outer wall of the housing 71 as it slides in and out of the connector.

Figure 8:
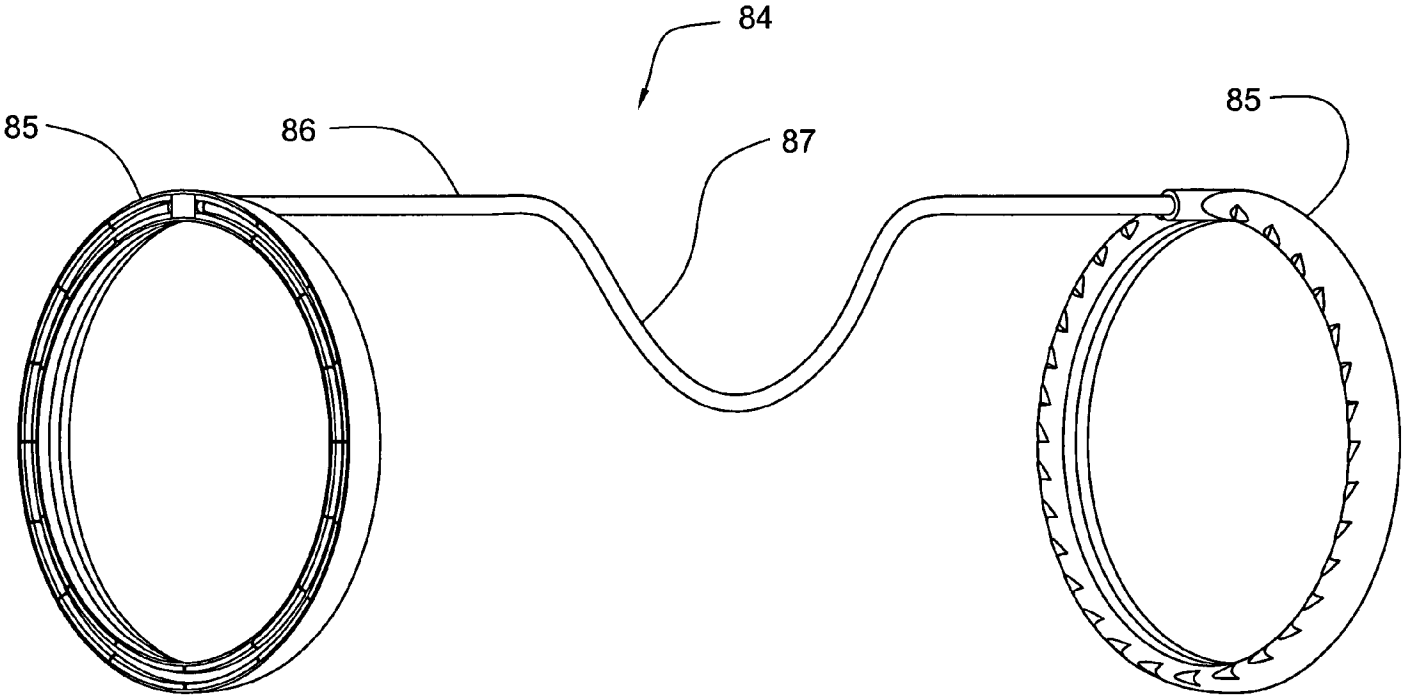
FIG. 8 is a diagram of transmission rings joined by a flexible transmission line.

FIG. 8 is a diagram of another embodiment of the extensible transmission line in a telemetry network 84. The transmission rings 85 are connected to transmission line 86 in the manner shown in FIG. 5. The transmission line features a flexible portion 87 that will permit the extension of the transmission line during operation of the downhole tool. The flexible portion 87 is depicted as an integral part of the transmission line 86. However, it could comprise corrugations or interlocking rings that would be less likely to fatigue over the life of the tool. Once again, the straight portions of the transmission line would likely require clamping while the flexible portion would remain free.

Figure 9:
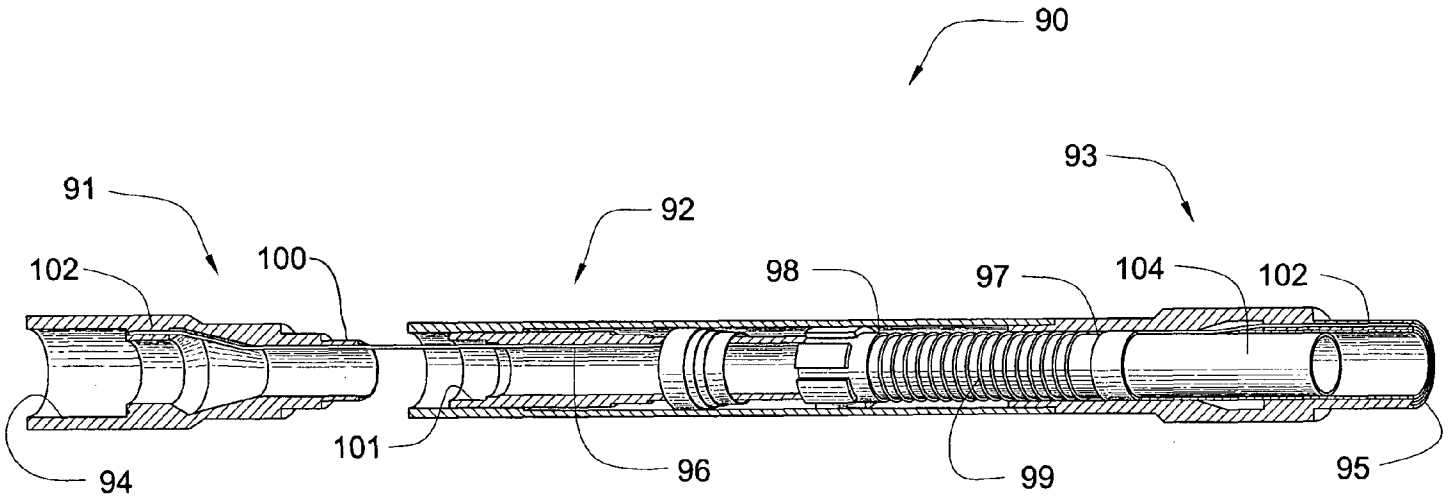
FIG. 9 is a diagram of a transmission network installed in an extensible downhole tool.

FIG. 9 is a diagram of an extensible downhole tool 90 adapted for telemetry in a downhole network. The tool comprises three segments 91, 92, and 93 that are made up to form a single tool similar in length to that of standard length drill pipe. Each segment has box and pin end tool joints 94, 95, 100 and 101. Transmission rings in the tool joints are provided with annular grooves and openings 102 connecting the grooves with inside wall of the tool like that shown in FIGS. 2 and 3. The tool of FIG. 9 has a single continuous transmission line 96 running the length of the tool. The transmission line 96 is installed before the active components of the tool are installed. Once the transmission line is in place, a tube 104 is then installed into the tool housing. The tube 104 provides a pathway for drilling fluids to circulate through the tool and at the same time creates an annulus into which the active components of the tool are assembled. The tube 104 may be segmented in order to assemble the various components of the tool and to seal the sections of the tool from each other. The extensible portion 99 of the transmission line 96 is housed within the annulus provided by the tube 104. Annular clamps 97 and 98 are provided to divide the extensible portion of the transmission line from the fixed portion. The fixed portion of the transmission line is located between the clamps 97 and 98 and the internal expansion ferrules located in the openings 102. As depicted, the extensible portion of the transmission line is a spring-wound conduit held in compression, however a telescoping connection or a flexible connection may be preferred in the region depending on the application of the tool. Moreover, it may be desired to have more than one extensible portion of the transmission line in a single tool. Each segment of the tool may be fitted with a fixed portion and an extensible portion of the transmission line in order to facilitate assembly of the tools. Nearly all active components of the cycleable tools that are employed in the drill string require the constraints depicted in FIG. 9. It is not the purpose of this disclosure to detail the workings of each tool that may benefit from the invention. On the other hand, it is the purpose to depict the manner in which transmission ring and an extensible transmission line may be employed to adapt downhole tools generally for incorporation into a telemetry network.

In cases where the box and pin ends of a tool undergo continuous or cyclic rotation, an electromagnetic coupler ring is provided in a closely-spaced, non-contact configuration. The transmission ring may couple in an axial direction, as shown in the figures herein. Alternatively, the transmission rings may couple in a radial fashion.

What is claimed:

1. An extensible downhole tool, comprising:

an elongate tube comprising box end and pin end tool joints;

the elongate tube further comprising at least one transmission ring connected to another transmission ring, by means of an extensible transmission line; wherein when the tool is connected to another tool having similarly disposed rings, the rings transmit an electronic signal from one tool to another, and wherein the transmission line comprises a flexible elongated portion.

2. The downhole tool of claim 1 selected from the group consisting of jars, hammers, and shock absorbers.

3. The downhole tool of claim 1, wherein the rings consist of a housing and an electrically conductive contact surface.

4. The downhole tool of claim 1, wherein the rings comprise a housing, an insulated conductor, a polymer, and a magnetically conductive trough.

5. The downhole tool of claim 1, wherein the transmission rings consist of a housing, an insulated conductor, a polymer, and magnetically conductive trough segments.

6. The downhole tool of claim 1, wherein the transmission rings are disposed within grooves located in shoulders in the tool joints.

7. The downhole tool of claim 6, wherein the transmission rings are connected to the transmission line through an opening in the wall of the tool joints that connects the grooves with the inside wall of the downhole tool.

8. The tool of claim 6, wherein at least a portion of the wall of the grooves comprise a non-circular cross section.

9. The tool of claim 6, wherein at least a portion of the wall of the rings diverge upward from the bottom.

10. The tool of claim 6, wherein the transmission rings are interference fit into the grooves.

11. The tool of claim 1, wherein the transmission rings are provided with discontinuities along their exterior surfaces.

12. The tool of claim 1, wherein the transmission rings are provided with serrations along their exterior surfaces.

13. The tool of claim 1, wherein the transmission rings are provided with barbs along their exterior surfaces.

14. The tool of claim 1, wherein the transmission line comprises a coaxially aligned center conductor, a dielectric material, a conductive shield adjacent the dielectric, and a stainless stain tube housing.

15. The tool of claim 1, wherein the transmission line comprises a coaxially aligned center conductor, a dielectric material, a conductive shield adjacent the dielectric, and a helical stainless steel tube housing.

16. The tool of claim 1, wherein the transmission line is held under compression during the cycling of the tool.

17. The tool of claim 1, wherein the transmission line is held under tension during the cycling of the tool.

18. The tool of claim 1, wherein the transmission line is held in tension greater than that seen by the elongated tube during operation of the drill string.

19. The tool of claim 1, wherein the transmission line is fixed using external clamping devices.

20. The tool of claim 1, wherein the transmission line comprises a connection comprising internal expansion ferrules.

21. The tool of claim 1, wherein the transmission line has a connection comprising an internal high-pressure seal.

22. The downhole tool of claim 1, wherein the electronic signal is transmitted continuously during the cycling of the tool.

23. The downhole tool of claim 1, wherein the electronic signal is transmitted intermittently during the cycling of the tool.

24. An extensible downhole tool, comprising:

an elongate tube comprising box end and pin end toot joints;

the elongate tube further comprising at least one transmission ring connected to another transmission ring, by means of an extensible transmission line; wherein when the tool is connected to another tool having similarly disposed rings, the rings transmit an electronic signal from one tool to another, and wherein the transmission line comprises a sealed, telescoping coaxial connection.

25. The downhole tool of claim 24 selected from the group consisting of jars, hammers, and shock absorbers.

* * * * *

UNITED STATES PATENT AND TRADEMARK OFFICE

CERTIFICATE OF CORRECTION

PATENT NO. : 7,852,232 B2
APPLICATION NO. : 10/358421
DATED : December 14, 2010
INVENTOR(S) : Hall et al.

It is certified that error appears in the above-identified patent and that said Letters Patent is hereby corrected as shown below:

Title page item (75) should read as follows:
(75) David R. Hall, Provo, UT (US); Joe Fox, Provo, UT (US); H. Tracy Hall, Jr., Provo, UT (US); David S. Pixton, Lehi, UT (US); James McPherson, Sandy, UT (US); Michael Briscoe, Lehi, UT (US)

Signed and Sealed this
Thirteenth Day of September, 2011

David J. Kappos

David J. Kappos
*Director of the United States Patent and Trademark Office*